US009303612B2

(12) United States Patent
Krittian et al.

(10) Patent No.: US 9,303,612 B2
(45) Date of Patent: Apr. 5, 2016

(54) HYDROSTATIC STARTER DEVICE OF AN INTERNAL COMBUSTION ENGINE

(71) Applicant: Linde Hydraulics GmbH & Co. KG, Aschaffenburg (DE)

(72) Inventors: Lukas Krittian, Aschaffenburg (DE); Martin Bergmann, Schaafheim (DE); Alfred Langen, Aschaffenburg (DE)

(73) Assignee: Linde Hydraulics GmbH & Co. KG, Aschaffenburg (DE)

( * ) Notice: Subject to any disclaimer, the term of this patent is extended or adjusted under 35 U.S.C. 154(b) by 247 days.

(21) Appl. No.: 14/023,565

(22) Filed: Sep. 11, 2013

(65) Prior Publication Data

US 2014/0165947 A1 Jun. 19, 2014

(30) Foreign Application Priority Data

Sep. 20, 2012 (DE) ..... 10 2012 108 857

(51) Int. Cl.
*F02N 11/08* (2006.01)
*F02N 7/00* (2006.01)
*F02N 15/02* (2006.01)

(52) U.S. Cl.
CPC ..... *F02N 11/0803* (2013.01); *F02N 7/00* (2013.01); *F02N 15/023* (2013.01)

(58) Field of Classification Search
CPC ..... F02N 7/00; F02N 7/08; F02N 11/0803; B60K 6/12; F15B 1/02; F15B 2211/20569
USPC ..... 123/179.31, 179.1, 179.3, 179.4, 197.1, 123/197.5, 198 D; 74/6, 7 R; 475/31, 72–83; 60/413, 482–484, 489
See application file for complete search history.

(56) References Cited

U.S. PATENT DOCUMENTS

| | | | | |
|---|---|---|---|---|
| 4,347,813 | A * | 9/1982 | Maucher et al. | 123/179.22 |
| 4,959,962 | A * | 10/1990 | Hagin et al. | 60/626 |
| 6,460,500 | B1 * | 10/2002 | Ooyama et al. | 123/179.3 |
| 6,971,232 | B2 * | 12/2005 | Singh | 60/414 |
| 2002/0166532 | A1 * | 11/2002 | Mori et al. | 123/179.31 |
| 2003/0000492 | A1 * | 1/2003 | Mori et al. | 123/179.31 |
| 2004/0107795 | A1 * | 6/2004 | Ito et al. | 74/730.1 |
| 2006/0032321 | A1 * | 2/2006 | Aitzetmueller et al. | 74/330 |

(Continued)

FOREIGN PATENT DOCUMENTS

| | | | |
|---|---|---|---|
| DE | 102008028547 | A1 | 12/2009 |
| EP | 2308795 | A1 | 4/2011 |

*Primary Examiner* — John Kwon
*Assistant Examiner* — Johnny H Hoang
(74) *Attorney, Agent, or Firm* — The Webb Law Firm

(57) ABSTRACT

A hydrostatic starter device (10) for an internal combustion engine (2) having a hydrostatic power unit (11) connected with the output shaft (4) of the internal combustion engine (2) is driven with hydraulic fluid from a hydraulic fluid accumulator (12). The hydrostatic starter device (10) has an electro-hydraulic charging device (30) to charge the hydraulic fluid accumulator (12) with hydraulic fluid and the hydrostatic power unit (11) is in a drive connection by a clutch device (25) with the internal combustion engine (2). The hydrostatic power unit (11) can be connected in a drive connection with the internal combustion engine (2) by the clutch device (25).

20 Claims, 4 Drawing Sheets

(56) References Cited

U.S. PATENT DOCUMENTS

| | | | | |
|---|---|---|---|---|
| 2007/0249455 | A1* | 10/2007 | Hasegawa et al. | 475/78 |
| 2009/0308065 | A1 | 12/2009 | Rea et al. | |
| 2010/0069193 | A1* | 3/2010 | Mueller et al. | 475/78 |
| 2010/0197438 | A1* | 8/2010 | Legner | 475/72 |
| 2011/0011074 | A1* | 1/2011 | Mellet et al. | 60/329 |
| 2012/0067037 | A1* | 3/2012 | Bohrer et al. | 60/450 |
| 2012/0080003 | A1* | 4/2012 | Schultz | 123/179.31 |
| 2012/0317967 | A1* | 12/2012 | Donohue | 60/423 |

* cited by examiner

HYDROSTATIC STARTER DEVICE OF AN INTERNAL COMBUSTION ENGINE

CROSS REFERENCE TO RELATED APPLICATION

This application claims priority to German Patent Application No. DE 10 2012 108857.8 filed Sep. 20, 2012, which is herein incorporated by reference in its entirety.

BACKGROUND OF THE INVENTION

1. Field of the Invention

This invention relates to a hydrostatic starter device for an internal combustion engine to start the internal combustion engine from a stop. The starter device has a hydrostatic power unit that is in a drive connection with the output shaft of the internal combustion engine, is in communication with a hydraulic accumulator, and is driven with hydraulic fluid from the hydraulic fluid accumulator to start the internal combustion engine.

2. Description of Related Art

On internal combustion engines, such as diesel or gasoline engines, starter devices driven by an electric motor are generally used. To start the internal combustion engine, the speed of rotation necessary for the self-sustaining running of the internal combustion engine is produced with an electric starter motor connected by a transmission with the crankshaft of the internal combustion engine. The transmission is generally formed by a pinion gear on the output shaft of the electric starter motor and a ring gear on the crankshaft of the internal combustion engine, and has a high translation ratio so that a high-speed and compact electric starter motor can be used.

To reduce the fuel consumption of the internal combustion engine during pauses or interruptions in operation, it is known that a start-stop function for the internal combustion engine can be provided, in which the idling internal combustion engine is shut off during pauses or interruptions in work and is automatically restarted when there is a request for torque. The shutdown and subsequent restarting of the internal combustion engine can occur even with relatively brief idle times, so that the starting process of the internal combustion engine must be carried out correspondingly frequently and at brief intervals during the operation of the internal combustion engine. This requirement places high demands on the starter device of the internal combustion engine with regard to endurance strength and the ability to supply the starting energy required to start the internal combustion engine.

On known starter devices operated with electric motors with a high-speed and compact electric starter motor, very strong currents are required to flow for a short period of time to start the internal combustion engine to produce the torque necessary to start the internal combustion engine. The currents that are generated to start the internal combustion engine result in a significant rise in temperature. If the internal combustion engine is to be restarted after short intervals for a start-stop function, this operating behavior results in the overheating of known starter devices operated with an electric motor and leads to the failure of the electric starter motor and, thus, of the starter device operated by the electric motor. To be able to actuate a conventional starter device of this type driven by an electric motor with an electrical starter motor for a start-stop function at brief intervals, the level of the electrical voltage must be increased and the electrical starter motor must be designed so that it has a correspondingly high fatigue strength. This results in a significant increase in the design effort and manufacturing costs required.

Known start-stop functions are associated with a hybridization of the drive train driven by the internal combustion engine, as a result of which the starting of the internal combustion engine and the increase in the speed of the internal combustion engine can occur in a short period of time. However, for a start-stop function of this type as part of a hybridization, additional components in the drive train are necessary in the form of an electrical flywheel-type motor or generator, a high-performance battery, a performance control module in the form of power electronics, and an electronic control system, as a result of which a start-stop function of this type requires significant extra construction effort and not insignificant extra costs.

DE 10 2008 028 547 A1 and EP 2 308 795 A1 describe internal combustion engines with a hydrostatic starter device in which a hydrostatic power unit is operated with hydraulic fluid from a hydraulic fluid accumulator to start the internal combustion engine. To eliminate the additional construction effort and expense for a starter device operated by an electric motor on the internal combustion engine, it must be ensured that the hydraulic fluid accumulator is charged before the internal combustion engine is shut off and/or that the hydraulic fluid accumulator can be charged while the internal combustion engine is shut off. In this regard, EP 2 308 795 A1 discloses an auxiliary charging device that can be used to charge the hydraulic fluid accumulator. In DE 10 2008 028 547 A1 and EP 2 308 795 A1, a hydraulic work pump in the drive train driven by the internal combustion engine, which supplies corresponding users of a hydraulic work system of a vehicle with hydraulic fluid, forms the hydrostatic power unit of the hydrostatic starter system. The hydraulic work pump can be operated as a hydraulic motor and, to start the internal combustion engine, is driven in operation as a motor by hydraulic fluid from the hydraulic fluid accumulator. However, the hydraulic work pump is rigidly coupled with the crankshaft or an output shaft of the internal combustion engine so that the hydraulic work pump is also driven after the start of the internal combustion engine. In this case, with known hydrostatic starter devices, high idle losses occur, in particular under operating conditions in which no users of the hydraulic work system are actuated.

An object of this invention is to provide a hydrostatic starter system of the general type described above but with which a start-stop function of the internal combustion engine can be provided in a rugged and economical construction, and the idle losses that occur during the operation of the internal combustion engine are reduced.

SUMMARY OF THE INVENTION

The invention teaches that this object is accomplished in that the hydrostatic starter system has an electrohydraulic charging device to charge the hydraulic fluid accumulator with hydraulic fluid and the hydrostatic power unit is in a drive connection by a clutch device with the internal combustion engine. By means of the clutch device, the hydrostatic power unit is placed in a drive connection with the internal combustion engine for the starting process. With an electrohydraulic charging device, it can be ensured, with little extra construction effort or expense, that the hydraulic fluid accumulator is filled with hydraulic fluid prior to the starting process of the internal combustion engine so that, with the hydrostatic power unit, the internal combustion engine can be started under all operating conditions, even after being shut off for a relatively long time. An additional starter device driven by an electric motor with an electrical starter motor is, therefore, unnecessary. The electrohydraulic charging device can charge the hydraulic fluid accumulator over a longer period of time so that only a compact electrohydraulic charging device with a low delivery volume and a low output is necessary and can be driven by the existing electrical on-board power supply of the internal combustion engine. By means of the clutch device, the hydrostatic power unit, which preferably performs exclusively the function of a starter to start the shut-off internal combustion engine, can be connected with the output shaft of the internal combustion engine to start the internal combustion engine. After the starting process, when the internal combustion engine is running on its own, the drive connection with the output shaft can be disconnected so that with the starter device of the invention, after the starting process of the internal combustion engine has been completed, the hydrostatic power unit is still not being driven by the internal combustion engine. Thus, the idling losses during the operation of the internal combustion engine can be reduced. With the starter device of the invention, a rugged, fail-safe and economical starter system is provided, which makes possible a start-stop function of the internal combustion engine at brief intervals and results in low idling losses of the internal combustion engine.

With the electrohydraulic charging device, the hydraulic fluid accumulator can be charged even during operation and, thus, the hydraulic fluid accumulator can be charged when the internal combustion engine is running, thus ensuring the charging of the hydraulic fluid accumulator even before the internal combustion engine is shut off. In one particularly advantageous configuration of the invention, the hydraulic fluid accumulator can be charged when the internal combustion engine is shut off by means of the electrohydraulic charging device to a volume of hydraulic fluid, which is sufficient for the starting process of the internal combustion engine. It thereby becomes possible in a simple manner to ensure the charging of the accumulator under all operating conditions even when the internal combustion engine is shut off, and the internal combustion engine can be started with the hydrostatic power unit and, thus, the hydrostatic starter device.

In one preferred embodiment of the invention, the electrohydraulic charging device has a charging pump driven by an electric motor. The charging pump is connected on the input side with a reservoir and on the output side with the hydraulic fluid accumulator. A pressure relief valve is associated with the hydraulic fluid accumulator to protect the pressure in the hydraulic fluid accumulator. With a pressure relief valve associated with the hydraulic fluid accumulator, for example with a delivery line of the charging pump, it becomes possible in a simple manner to ensure that the hydraulic fluid accumulator is charged before the starting process of the internal combustion engine with a volume of hydraulic fluid which is sufficient for the starting process of the internal combustion engine because, during the charging process, the pressure generated by the electrohydraulic charging device can be set and secured.

In one development of the invention, a check valve that opens toward the hydraulic fluid accumulator is located in a delivery line of the charging pump. With a check valve of this type in the delivery line of the charging pump, it is possible in a simple manner to prevent the hydraulic fluid accumulator from emptying as a result of leakage of the shut-off charging pump when the electrohydraulic charging device is shut down.

In one advantageous configuration of the invention, the clutch device is a freewheeling clutch. With a freewheeling clutch located between the internal combustion engine and the hydrostatic power unit that functions as the starter of the internal combustion engine, the hydrostatic power unit can be connected with the crankshaft of the internal combustion engine by a freewheel (overrunning) with little extra construction effort or expense. With a freewheeling clutch of this type, low idling losses in the operation of the internal combustion engine can be achieved with little extra construction or expense. Only during the starting process of the internal combustion engine a torque is outputted by the hydrostatic power unit to the crankshaft of the internal combustion engine. After the starting process, the drive connection between the internal combustion engine and the hydrostatic power unit is automatically disconnected by the freewheel of the freewheeling clutch when the internal combustion engine is running on its own because, after the starting process, the speed generated by the internal combustion engine and the torque generated by the internal combustion engine predominate.

In an alternative embodiment of the invention, the clutch device is a separating clutch. With a separating clutch, it is possible in a simple manner to reduce the idling losses during the operation of the internal combustion engine after the starting process of the internal combustion engine by separating the drive connection between the hydrostatic power unit of the hydrostatic starter device and the internal combustion engine, which is running by itself.

In one advantageous development of the invention, the electrohydraulic charging device has a relief valve by means of which the hydraulic fluid accumulator can be depressurized toward the reservoir. With a relief valve of this type, the hydraulic fluid accumulator can be depressurized to the reservoir in a controlled manner, for example during relatively long pauses in operation or when the internal combustion engine is shut down for extended periods of time, thereby also achieving a high level of operational reliability of the starter device.

It is advantageous if the relief valve is located in a connecting line that runs from the hydraulic fluid accumulator to the reservoir and is in the form of an electrically actuated control valve, in particular a switched valve, with an off position and an on position. With an electrically actuated control valve of this type, the depressurization of the hydraulic fluid accumulator can be controlled with little extra construction effort or expense.

To control the starting process of the internal combustion engine, in one advantageous embodiment of the invention, an electrically actuated starter valve (which can be actuated into an open position for the starting process of the internal combustion engine and can be actuated into a closed position after the starting process of the internal combustion engine) is located in a line connecting the hydraulic fluid accumulator with the hydraulic power unit of the starter device. With an electrically actuated starter valve of this type, it is possible in a simple manner to form a starter valve for the control of the starting process of the internal combustion engine. The starter valve is actuated into an open position during the starting process of the internal combustion engine, as a result of which the hydrostatic power unit is driven by the pressurized hydraulic fluid from the hydraulic fluid accumulator and cranks the internal combustion engine so that it starts. After the internal combustion engine has been started, the starter valve is actuated into the closed position, so that no further hydraulic fluid flows from the hydraulic fluid accumulator to the hydrostatic power unit once the internal combustion engine is running on its own.

It is particularly advantageous if, as in one embodiment of the invention, the clutch device is actuated hydraulically. A control line of the clutch device is connected with the connecting line of the hydraulic fluid accumulator and with the hydrostatic power unit between the starter valve and the hydrostatic power unit. With a hydraulically actuated clutch device of this type, it is possible, in a simple manner during a starting process and with the starter valve actuated accordingly, to automatically actuate the clutch device to connect the hydrostatic power unit in a drive connection with the internal combustion engine.

Alternatively or additionally, the clutch device can be actuated hydraulically, and a control line of the clutch device can be connected to a lubricating oil system of the internal combustion engine. It is, therefore, possible in a simple manner to actuate the clutch device when the internal combustion engine is running. A lubricating pressure is generated in the lubricating oil system of the internal combustion engine to supply the lubrication points inside the engine.

In one advantageous development of the invention, a circulation line is provided on the hydrostatic power unit. The circulation line connects an inlet side with an outlet side of the hydrostatic power unit and is provided with a shutoff valve that closes toward the outlet side. With a circulation line of this type, it is possible in a simple manner, after the disconnection of the hydrostatic power unit from the running internal combustion engine by means of the clutch device, to allow the hydrostatic power unit to run out in an unpressurized circulation operation. The shutoff valve in the circulation line that opens in the direction of the outlet side prevents in a simple manner the escape of hydraulic fluid from the hydraulic fluid accumulator, bypassing the hydrostatic power unit, to the outlet side during the starting process of the internal combustion engine.

The hydrostatic power unit can optionally be in the form of a hydraulic motor with a fixed displacement volume or a hydraulic motor with a variable displacement volume. In particular, a hydraulic motor with a fixed displacement volume, which operates exclusively as a motor and performs the function of a hydrostatic starter for the internal combustion engine, requires a low level of construction effort and expense and makes possible an economical realization of the hydrostatic starter device of the invention.

Alternatively, the hydrostatic power unit can be in the form of a hydraulic motor and a hydraulic pump with a fixed displacement volume or a hydraulic motor and hydraulic pump with a variable displacement volume. When the power unit functions as a hydraulic pump with the internal combustion engine running, it makes it possible to charge the hydraulic fluid accumulator. With a power unit operating as a motor and as a pump, it is possible with little extra construction effort or expense, when the power unit is operating as a motor, to perform the function of a hydrostatic starter of the internal combustion engine and, when the power unit is operating as a pump, to charge the hydraulic fluid accumulator while the internal combustion engine is running on its own.

In one development to the invention, it is particularly advantageous to locate, in an outlet line of the hydrostatic power unit, an electrically actuated switching valve which, in a first valve position, closes a charging line that runs to the hydraulic pressure accumulator and connects the outlet line with a reservoir, and, in a second valve position, shuts off the connection of the outlet line with the reservoir and connects the charging line with the outlet line. When the hydrostatic power unit is operating as a pump, the switching valve makes it possible in a simple manner to connect the outlet side of the power unit with the hydraulic fluid accumulator, so that the hydraulic fluid accumulator can be charged by the power unit.

If a suction line that is in communication with the reservoir is connected to the connecting line between the starter valve and the hydrostatic power unit, in which suction line there is a shutoff valve that shuts off the connection to the reservoir, it is easily possible for the power unit operating as a pump to suck hydraulic fluid out of the reservoir with the inlet side to charge the hydraulic fluid accumulator.

For this purpose, the hydrostatic power unit can advantageously be placed in a drive connection with the internal combustion engine by the clutch device to charge the hydraulic fluid accumulator.

The hydrostatic power unit operating as a starter of the internal combustion engine is preferably a gearwheel machine or an axial piston machine or radial piston machine. Constructions of this type of hydrostatic power units, in particular a gearwheel machine, are characterized by low manufacturing costs, rugged construction, and reliable operation.

In one advantageous embodiment of the invention, the charging pump is a hydraulic pump with a fixed displacement volume. Because on the starter device of the invention the hydraulic fluid accumulator can be charged over a longer period of time with small charging flows, with a charging pump in the form of a hydraulic pump with a fixed displacement volume, it is possible to achieve a simply constructed and economical electrohydraulic charging device.

The charging pump is advantageously a gearwheel machine or an axial piston machine or a radial piston machine. Constructions of hydrostatic power units of this type are characterized, in particular in an embodiment with a fixed displacement volume, by low manufacturing costs and reliable operation.

The starter device of the invention can be used to start an internal combustion engine which drives a drive train that is not provided with additional hydraulic systems, such as hydraulic work systems, which are driven by the internal combustion engine. For operation of the hydrostatic starter device on a drive train of this type without any additional hydraulic work systems, an independent circuit carrying a pressurized medium can be provided, such as a suitable hydraulic fluid. On a drive train without additional hydraulic work systems driven by the internal combustion engine, it is particularly advantageous if, as in one embodiment of the invention, the engine oil of the internal combustion engine is used as the hydraulic fluid for operation of the hydrostatic starter system, so that no separate circuit carrying a pressurized medium, such as a hydraulic fluid, is necessary for operation of the hydrostatic starter device.

The internal combustion engine, which is equipped with a hydrostatic starter device of the invention, can be in the form of a stationary engine.

Alternatively, the internal combustion engine equipped with a hydrostatic starter device of the invention can be a drive engine of a vehicle. The vehicle can be a vehicle that does not have additional hydrostatic hydraulic work systems or it can be provided with a hydrostatic hydraulic work system in the drive train which is driven by the internal combustion engine, which drive train has at least one hydraulic work pump driven by the internal combustion engine to supply the users of the hydraulic work system with hydraulic fluid.

BRIEF DESCRIPTION OF THE DRAWINGS

Additional advantages and details of the invention are explained in greater detail below with reference to the exemplary embodiments illustrated in the accompanying schematic figures, wherein the reference numbers identify like parts throughout.

DESCRIPTION OF THE PREFERRED EMBODIMENTS

Figure 1:
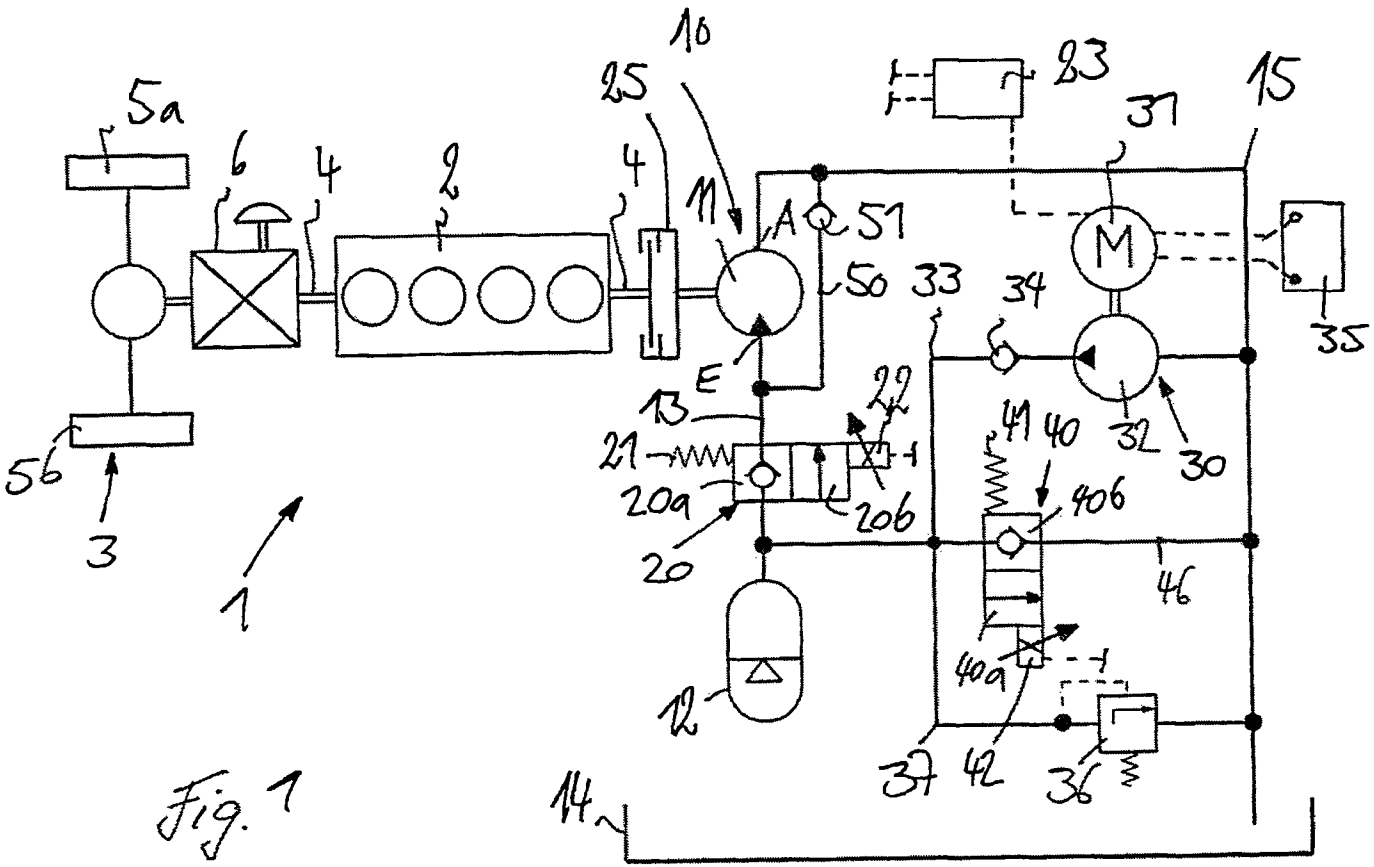
FIG. 1 shows a first embodiment of a drive train having a starter device of the invention.

FIG. 1 is a schematic diagram showing a drive train 1 of a vehicle, such as an automobile for example, which is not illustrated in further detail and is operated with an internal combustion engine and is not equipped with a hydraulic work system.

The drive train 1 includes an internal combustion engine 2, such as a diesel engine or a gasoline engine, and a traction drive 3 driven by the internal combustion engine 2.

The traction drive 3 can be in the form of a hydrostatic traction drive, which is not illustrated in any further detail and is in the form of a variable displacement traction pump, which is in a drive connection with an output shaft 4 of the internal combustion engine 2, and one or more fixed or variable displacement hydraulic motors, which are connected in a closed or open circuit to the traction pump and are in an operative connection with the driven wheels 5*a*, 5*b*, of the vehicle. The traction drive 3 can also be in the form of an electrical traction drive with an electric generator driven by the internal combustion engine 2 and one or more electrical traction motors that drive the wheels 5*a*, 5*b*. A mechanical traction drive with a mechanical transmission 6, such as a multi-speed manual transmission, an automatic transmission, a power split transmission, or a torque converter transmission, can also be provided as the traction drive 3 to drive the wheels 5*a*, 5*b*.

As the starter for the internal combustion engine 2, with which the shut-off internal combustion engine 2 can be started from a stop, a hydrostatic starter device 10 is provided, which has a hydrostatic power unit 11 connected in a drive connection with the output shaft 4, e.g., the crankshaft, of the internal combustion engine 2, which power unit is connected with a hydraulic fluid accumulator 12 and, to start the internal combustion engine 2, can be driven with hydraulic fluid from the hydraulic fluid accumulator 12.

The hydrostatic power unit 11 of the hydrostatic starter device 10 of the invention illustrated in FIG. 1 is formed by a hydraulic motor that operates exclusively as a motor. In the illustrated exemplary embodiment, the hydraulic motor is in the form of a hydraulic motor with a fixed and therefore constant displacement volume.

The hydrostatic power unit 11 in the form of a hydraulic motor is connected on the input side with an inlet side E on the hydraulic fluid accumulator 12. For this purpose, a connecting line 13 runs from the hydraulic fluid accumulator 12 to the inlet side of the power unit 11. The power unit 11 is in communication on an outlet side A with a reservoir 14. For this purpose an outlet line 15 connected to the outlet side A of the power unit 11 is connected to the reservoir 14.

The power unit 11 is operated exclusively in one direction of delivery from the hydraulic fluid accumulator 12 to the reservoir 14 and, thus, exclusively as a motor to drive the output shaft 4 and therefore has exclusively the function of a starter for the internal combustion engine 2.

To control the starting process of the internal combustion engine 2, there is a start valve in the connecting line 13 that performs the function of a starter valve and has a closed position 20*a* and an open position 20*b*. The starter valve 20 is actuated by a spring device 21 into the closed position 20*a* and is electrically actuated into the open position 20*b*.

An electrical actuator device 22, such as an actuator magnet, is provided which is in communication for its actuation with an electronic control circuit 23. The control valve 20 is preferably in the form of a switched valve.

The starter device 10 further comprises a clutch device 25 by means of which the hydraulic motor 11 can be connected in a drive connection with the output shaft 4 of the internal combustion engine 2.

The hydrostatic starter device 10 is provided with an electrohydraulic charging device 30 so that the hydraulic fluid accumulator 12 can be charged with hydraulic fluid even when the internal combustion engine 2 is shut off. The electrohydraulic charging device 30 has a hydrostatic charging pump 32 driven by an electric motor 31. The charging pump 32 is connected on the inlet side with the reservoir 14 and on the outlet side delivers into the hydraulic fluid accumulator 12. A delivery line 33 of the charging pump 32 is connected to the connecting line 13 between the starter valve 20 and the hydraulic fluid accumulator 12. Located in the delivery line 33 is a shutoff valve 34, such as a check valve, that opens in the direction of the hydraulic fluid accumulator 12 and which, when the charging pump 32 is shut off, prevents a depressurization of the hydraulic fluid accumulator 12 as a result of leakage of the charging pump 32. In the illustrated exemplary embodiment, the charging pump 32 is a hydraulic pump having a fixed and therefore constant displacement volume. The electric motor 31 that drives the charging pump 32 is connected with a conventional starter battery 35 for its electric power supply. The electric motor 31 is in connection with the electronic control device 23 for its control and actuation.

On the starter device 10, associated with the hydraulic pressure accumulator 12 is a pressure relief valve 36 that protects the pressure in the hydraulic fluid accumulator 12, by means of which the accumulator charging pressure in the hydraulic fluid accumulator 12 and, thus, the operating pressure of the hydrostatic starter device 10 are guaranteed. In the illustrated exemplary embodiment, the pressure relief valve 36 is associated with the delivery line 33 of the charging pump 32 that runs from the charging pump 32 to the hydraulic pressure accumulator 12 and is located in a connecting line 37 that runs from the delivery line 33 to the reservoir 14.

On the starter device 10, a relief valve 40 is also provided, with which the hydraulic fluid accumulator 12 can be discharged to the reservoir 14 in a controlled manner.

The relief valve 40 is located in a connecting line 46 that runs from the hydraulic pressure accumulator 12 to the reservoir 14 and is in the form of an electrically actuated control valve with a closed position 40*b* and an open position 40*a*. The relief valve 40 is actuated into the closed position 40*b* by a spring device 41 and into the open position 40*a* electrically. For this purpose, an electric actuator device 42, such as an actuator magnet, is provided, which, for its actuation, is in connection with an electronic control device 23. The relief valve 40 is preferably in the form of a switched valve.

On the hydrostatic power unit 11 that functions as the starter of the internal combustion engine 2, a circulation line 50 is provided which connects the inlet side E with the outlet side A. Also in the circulation line 50 is a shutoff valve 51 that closes the line toward the outlet side A and can be in the form of a check valve, for example.

On the starter device 10 illustrated in FIG. 1, the power unit 11 is in the form of a hydraulic motor and functions exclusively as the starter to start the internal combustion engine 2.

The hydraulic pressure accumulator 12 can be charged with hydraulic fluid exclusively by the electrohydraulic charging device 30.

The hydraulic pressure accumulator 12 can be charged with the electrohydraulic charging device 30 during operation of the internal combustion engine 2. A particular advantage of the electrohydraulic charging device 30 is that the hydraulic fluid accumulator 12 can also be charged with the electrohydraulic charging device 30 with a sufficient volume of hydraulic fluid for a starting process of the internal combustion engine 2 when the internal combustion engine 2 is shut off. This ensures that the hydraulic fluid accumulator 12 is always charged prior to a starting process of the internal combustion engine 2 with a volume of hydraulic fluid sufficient for the starting process. The electrohydraulic charging device 30 charges the hydraulic fluid accumulator 12 with small charging flow over a relatively long period of time so that the charging pump 32 can have a low displacement volume and the electric motor 31 requires a low power. Thus, it becomes possible to have a simply constructed and economical electrohydraulic charging device 30 which can be operated with electrical energy from the starter battery 35.

On the starter device 10, the hydraulic fluid accumulator 12 is charged with the electrohydraulic charging device 30 prior to the starting process of the internal combustion engine 2 with a volume of hydraulic fluid sufficient for the starting process of the internal combustion engine 2. The charging process of the hydraulic fluid accumulator 12 can be controlled and protected by the pressure relief valve 36. The hydraulic fluid accumulator 12 can also be charged with the electrohydraulic charging device 30 when the internal combustion engine 2 is shut off.

To start the internal combustion engine 2, the starter valve 20 is actuated by the electronic control device 23 into the open position 20*b* so that hydraulic fluid from the charged hydraulic fluid accumulator 12 flows to the hydrostatic power unit 11, which is in the form of a hydraulic motor, on the input side E. For the starting process of the internal combustion engine 2, the hydrostatic power unit 11 is in a drive connection of the clutch device 25 with the output shaft 4 of the internal combustion engine 2, so that the power unit 11 driven by the hydraulic fluid from the hydraulic fluid accumulator 12 acting as the hydraulic starter cranks the output shaft 4 of the internal combustion engine 2, which starts as a result of this process. After the starting of the internal combustion engine 2, the starter valve 20 is actuated into the closed position 20*a* by terminating the actuation of the spring device 21. After the starting process, the clutch device 25 disconnects the internal combustion engine 2 once the internal combustion engine 2 is running independently and interrupts the drive connection between the power unit 11 and the output shaft 4 so that, as the internal combustion engine 2 continues to run, the power unit 11 of the hydrostatic starter system 10 is prevented from being driven along with it and therefore low idling losses of the running internal combustion engine 2 are achieved.

Figure 2:
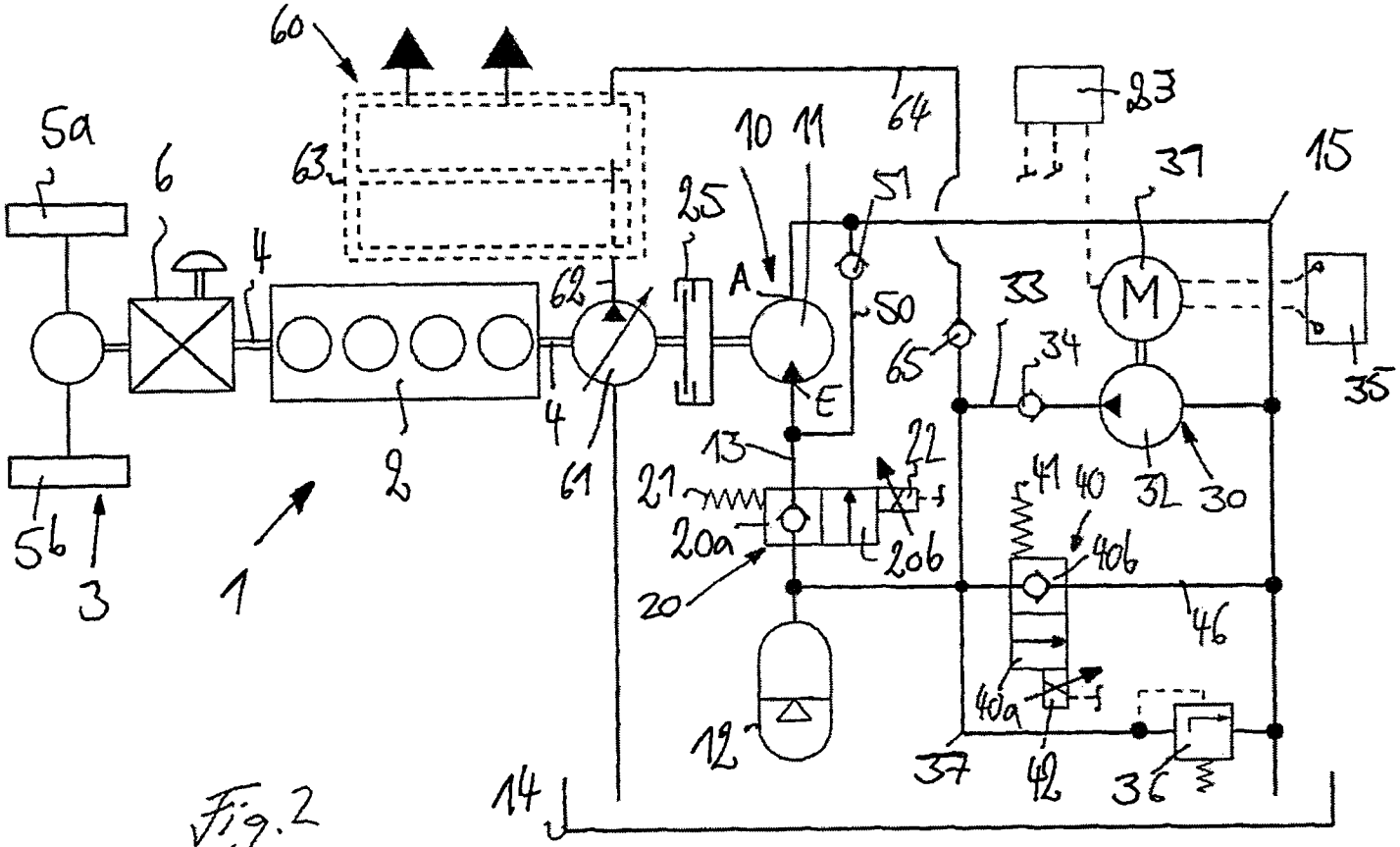
FIG. 2 shows a second embodiment of a drive train having a starter device of the invention.

FIG. 2 is a schematic diagram showing a drive train 1 of the invention of a mobile work machine, such as an industrial truck or a construction vehicle or an agricultural vehicle, which is not illustrated in any further detail, and is driven by an internal combustion engine, and is equipped with a hydraulic work system. Components that are identical with components in FIG. 1 are identified with identical reference numbers.

In the drive train 1, in addition to the traction drive 3 and the hydrostatic starter device 10, there is a hydraulic work system 60 which is driven by the internal combustion engine 2. The hydraulic work system 60 comprises the work functions of the industrial vehicle, such as on an industrial truck, the work functions of actuating load holding means on a lifting mast, or on a construction vehicle in the form of an excavator, the work functions of a working device formed by a shovel. To supply the users, the hydraulic work system 60 has one or more hydraulic work pumps 61 which are operated in an open circuit and are in a drive connection with the output shaft 4 of the internal combustion engine 2. The hydraulic work pump 61 is in communication on the input side with the reservoir 14 and delivers into a delivery line 62, which leads to a control valve block 63 in which are located the control valves for the control of the users of the hydraulic work system 60. When the internal combustion engine 2 is running, the hydraulic fluid accumulator 12 can be charged by the hydraulic work pump 6 in addition to or as an alternative to the electrohydraulic charging device 30. For this purpose, a charging line 64 leads from the control valve block 63 to the hydraulic fluid accumulator 12, in which line 64 there is a shutoff valve 65, such as a check valve, which opens in the direction of the hydraulic fluid accumulator 12. In the illustrated exemplary embodiment, the charging line 64 is connected to the delivery line 33 of the charging pump 32.

Figure 3:
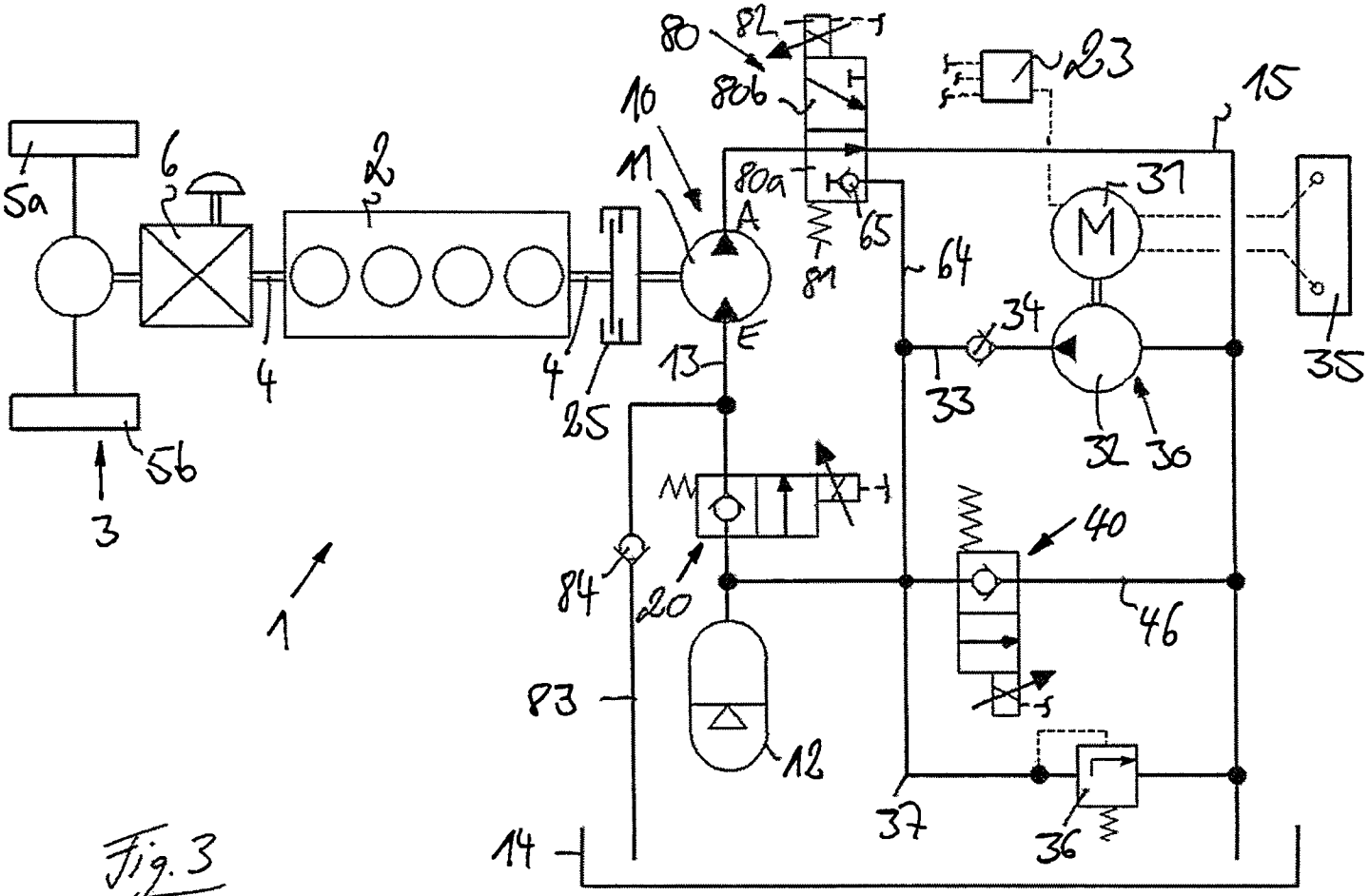
FIG. 3 shows an alternative of the embodiment illustrated in FIG. 1.

FIG. 3 illustrates the development of the embodiment illustrated in FIG. 1, in which the hydrostatic power unit 11 can be operated as a motor to start the internal combustion engine 2 and, in the same direction of rotation, can also be operated as a pump to charge the hydraulic fluid accumulator 12 when the internal combustion engine 2 is running. The hydraulic fluid accumulator 12 can be charged when the internal combustion engine 2 is running, in addition to or as an alternative to the electrohydraulic charging device 30, by the power unit 11 which is operating as a pump and delivering into the output line 15. For this purpose, in the outlet line 15 of the power unit 11 there is a switching valve 80 which in a first switched position 80*a* shuts off the charging line 64 that leads to the hydraulic fluid accumulator 12 and connects the outlet side A of the power unit 11 with the reservoir 14, and in a second switched position 80*b* closes the connection between the outlet side A of the power unit 11 with the reservoir 14 and connects the charging line 64 with the outlet side A of the power unit 11. The first switched position 80*a* is provided with a shutoff valve 65, such as a check valve, which shuts off the charging line 64.

The switching valve 80 is actuated by a spring device 81 into the first switched position 80*a* and can be actuated electrically into the second switched position 80*b*. For this purpose, an electrical actuator device 82, such as an actuator magnet, is provided, which for its actuation is in communication with the electronic control device 23.

In the illustrated exemplary embodiment, the charging device 64 is connected to the delivery line 33 of the charging pump 32.

Connected to the connecting line 13 between the starter valve 20 and the inlet side E of the power unit 11 there is a suction line 83 which is in communication with the reservoir 14, in which suction line 83 there is a shutoff valve 84, such as a check valve, which shuts off the line in the direction of the reservoir.

For charging of the hydraulic fluid accumulator 12 by the power unit 11 operating as a pump, the power unit 11 is placed in a drive connection by the clutch device 25 with the output shaft 4 of the internal combustion engine 2 and the switching valve 80 is actuated into the second switched position 80*b*, so that the power unit 11 (which is operating as a pump and is driven by the internal combustion engine 2) sucks in hydraulic fluid on the input side via the suction line 83 and the open shutoff valve 84 from the reservoir 14 and delivers it on the output side via the charging line 64 into the hydraulic fluid accumulator 12.

Figure 4:
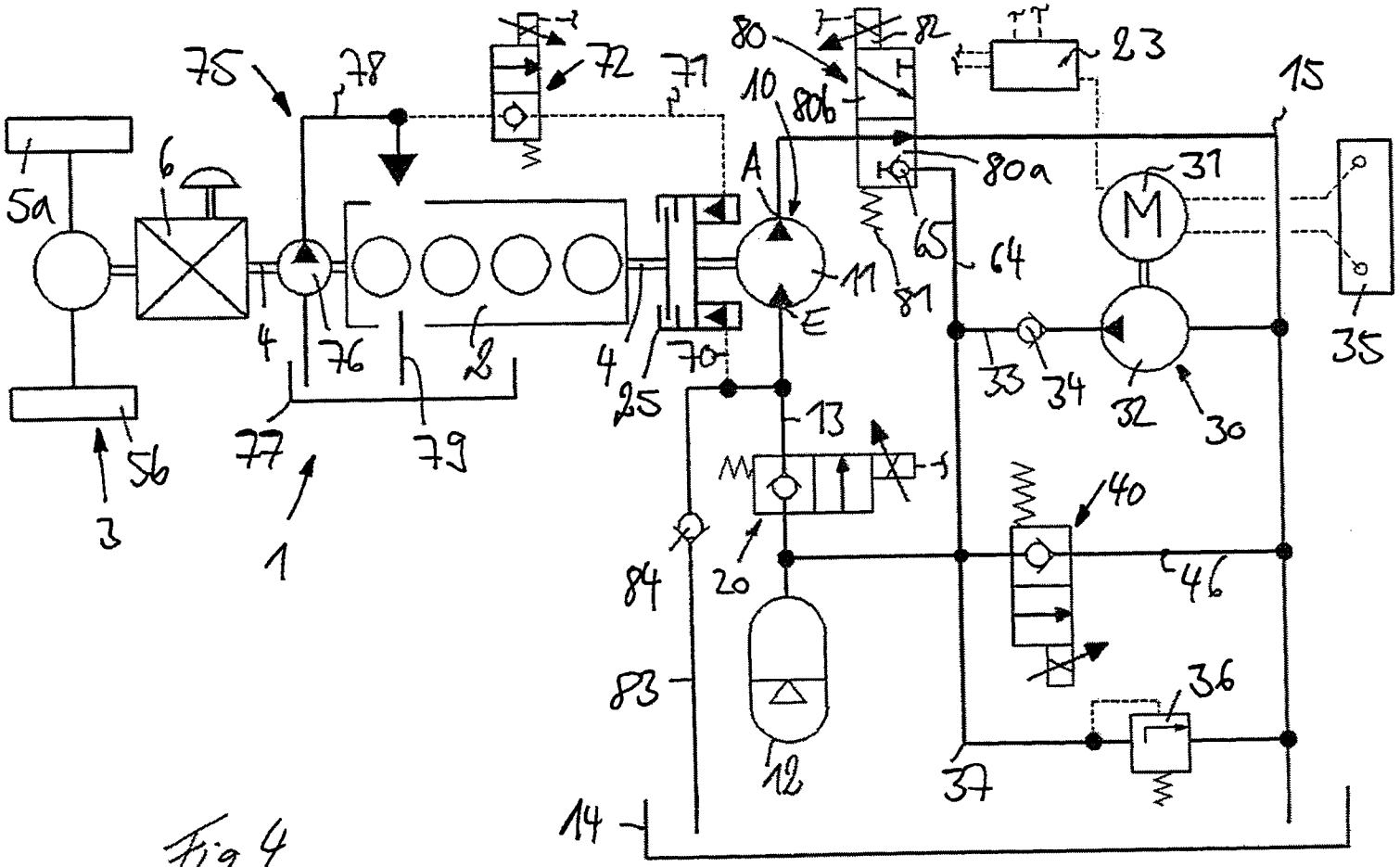
FIG. 4 shows an embodiment of the invention with a hydraulically actuated clutch device.

FIG. 4 illustrates an embodiment of the invention with a hydraulically actuated clutch device 25. A control line 70 that actuates the clutch device 25 is connected with the connecting line 13 of the hydraulic fluid accumulator 12 and with the hydrostatic power unit 11 between the starter valve 20 and the hydrostatic power unit 11. During the starting process of the internal combustion engine 2, with a corresponding actuation of the starter valve 20, the clutch device 25 can therefore be automatically actuated by the hydraulic fluid from the hydraulic fluid accumulator 12 to establish a drive connection of the hydrostatic power unit 11 by the clutch device 25 with the output shaft 4 of the internal combustion engine 2 to start the internal combustion engine 2, and to disconnect the power unit 11 from the output shaft 4 after the starting of the internal combustion engine 2.

Additionally or alternatively, a control line 71 that actuates the clutch device 25 is provided, which is connected with a lubricating oil system 75 of the internal combustion engine 2. Located in the control line 71 is a control valve 72 with which the actuation of the clutch device 25 by the lubricant pressure generated in the lubricating oil system 75 can be controlled. For its actuation, the control valve 72 is preferably connected with the electronic control device 23 and is in the form of a switched valve.

The lubricating oil system 75 has a lubricating oil pump 76 driven by the output shaft 4 of the internal combustion engine 2 and which is in communication on the input side with a lubricant reservoir 77, such as an engine oil pan of the internal combustion engine 2, and sucks lubricant out of the lubricant reservoir 77. On the output side, the lubricating oil pump 76 delivers into a lubricating oil system 78, by means of which the lubrication points inside the engine (which are indicated in FIG. 4 by an arrow on the internal combustion engine 2) are supplied with lubricant. The lubricant can flow back into the lubricant reservoir 77 by means of a return line 79 after it has flowed through the lubrication points inside the engine. The lubrication points on an internal combustion engine 2, which can be in the form of a reciprocating piston engine, for example, are formed by the bearings of a rotating camshaft, the bearings of rotating balancer shafts, the bearings of connecting rods, and the bearings of the crankshaft, which are hydrostatic and/or hydrodynamic bearing points.

When the internal combustion engine 2 is running, by means of an appropriate actuation of the control valve 72, the power unit 11 can be connected with the output shaft 4 of the internal combustion engine 2, so that when the internal combustion engine 2 is running, alternatively or in addition to the electrohydraulic charging device 30, the hydraulic fluid accumulator 12 can be charged by the power unit 11 operating as a pump.

The hydrostatic starter device 10 of the invention has a series of advantages. The hydrostatic starter device 10 can be operated to achieve a start-stop function of the internal combustion engine 2 at brief intervals without any danger of overheating. With the hydrostatic starter device 10, a start-stop function is achieved in the form of a rugged, fail-safe, and economical construction. On account of the use of the electrohydraulic charging device 30 of the hydrostatic starter device 10, no conventional starter device driven by an electric motor with an electric motor as a starter motor is required on the internal combustion engine 2.

The hydrostatic power unit 11 and the clutch device 25 of the hydrostatic starter device 10 can be located at any desired point in the drive train 1 driven by the internal combustion engine 2.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. A hydrostatic starter device for an internal combustion engine to start the shut-off internal combustion engine from a stop, comprising:

a hydrostatic power unit in a drive connection with an output shaft of an internal combustion engine, wherein the hydrostatic power unit is in communication with a hydraulic fluid accumulator and is driven with hydraulic fluid from the hydraulic fluid accumulator to start the internal combustion engine, wherein the hydrostatic starter device includes an electrohydraulic charging device to charge the hydraulic fluid accumulator with hydraulic fluid, and wherein the hydrostatic power unit is connected in a drive connection with the internal combustion engine by a clutch device for a starting process of the internal combustion engine, wherein the electrohydraulic charging device includes a charging pump driven by an electric motor and is connected on an input side with a reservoir and delivers on an output side into the hydraulic fluid accumulator, and wherein a pressure relief valve to protect a pressure in the hydraulic fluid accumulator is operationally connected to the hydraulic fluid accumulator, wherein a shutoff valve that opens in a direction of the hydraulic fluid accumulator is located in a delivery line of the charging pump, wherein an electrically actuated starter valve is located in a connecting line between the hydraulic fluid accumulator and the hydrostatic power unit of the starter device, which starter valve is actuated into an open position for the starting process of the internal combustion engine and is actuated into a closed position after the starting process of the internal combustion engine, wherein the delivery line of the charging pump is connected to the connecting line between the hydraulic fluid accumulator and the starter valve, wherein the shutoff valve is located in the delivery line of the charging pump, and wherein the pressure relief valve is connected to the delivery line of the charging pump between the shutoff valve and the hydraulic fluid accumulator.

2. The hydrostatic starter device as recited in claim 1, wherein when the internal combustion engine is shut off, the hydraulic fluid accumulator is charged by the electrohydraulic charging device with a volume of hydraulic fluid sufficient for the starting process of the internal combustion engine.

3. The hydrostatic starter device as recited in claim 1, wherein the clutch device is a freewheeling clutch.

4. The hydrostatic starter device as recited in claim 1, wherein the clutch device is a separating clutch.

5. The hydrostatic starter device as recited in claim 1, including a relief valve configured to depressurize the hydraulic fluid accumulator to the reservoir.

6. The hydrostatic starter device as recited in claim 5, wherein the relief valve is located in a connecting line that leads from the hydraulic fluid accumulator to the reservoir and is an electrically actuated control valve with a closed position and an open position.

7. The hydrostatic starter device as recited in claim 1, wherein the clutch device is hydraulically actuated, and wherein a control line of the clutch device is connected with the connecting line of the hydraulic fluid accumulator, with the hydrostatic power unit between the starter valve and the hydrostatic power unit.

8. The hydrostatic starter device as recited in claim 1, wherein the clutch device is hydraulically actuated and a control line of the clutch device is connected to a lubricating oil system of the internal combustion engine.

9. The hydrostatic starter device as recited in claim 1, including a circulation line provided on the hydrostatic power unit, wherein the circulation line connects an inlet side with an outlet side of the hydrostatic power unit and is provided with a shutoff valve which closes toward the outlet side.

10. The hydrostatic starter device as recited in claim 1, wherein the hydrostatic power unit is selected from the group consisting of a hydraulic motor with a fixed displacement volume and a hydraulic motor with a variable displacement volume.

11. The hydrostatic starter device as recited in claim 1, wherein the hydrostatic power unit is selected from the group consisting of a hydraulic motor and hydraulic pump with a fixed displacement volume, and a hydraulic motor and hydraulic pump with a variable displacement volume, and wherein the power unit, acting as a hydraulic pump when the internal combustion engine is running, allows charging of the hydraulic fluid accumulator.

12. The hydrostatic starter device as recited in claim 11, including an electrically actuated switching valve located in an outlet line of the hydrostatic power unit and which in a first switched position shuts off a charging line that leads to the hydraulic fluid accumulator and connects the outlet line with the reservoir, and in a second switched position closes the connection of the outlet line with the reservoir and connects the charging line with the outlet line.

13. The hydrostatic starter device as recited in claim 11, including a suction line connected to the connecting line between the starter valve and the hydrostatic power unit and in communication with the reservoir, in which suction line there is a shutoff valve which closes in the direction of the reservoir.

14. The hydrostatic starter device as recited in claim 11, wherein the hydrostatic power unit is placed in a drive connection with the internal combustion engine by the clutch device to charge the hydraulic fluid accumulator.

15. The hydrostatic starter device as recited in claim 1, wherein the hydrostatic power unit is selected from the group consisting of a gearwheel machine, an axial piston machine, and a radial piston machine.

16. The hydrostatic starter device as recited in claim 1, wherein the charging device comprises a hydraulic pump with a fixed displacement volume.

17. The hydrostatic starter device as recited in claim 1, wherein the charging device is selected from the group consisting of a gearwheel machine, an axial piston machine, and a radial piston machine.

18. The hydrostatic starter device as recited in claim 1, wherein the hydraulic fluid comprises engine oil of the internal combustion engine.

19. The hydrostatic starter device as recited in claim 1, wherein the internal combustion engine is a stationary engine.

20. The hydrostatic starter device as recited in claim 1, wherein the internal combustion engine is a drive motor of a motor vehicle.

* * * * *